US011679903B2

(12) United States Patent
Yildirim et al.

(10) Patent No.: US 11,679,903 B2
(45) Date of Patent: Jun. 20, 2023

(54) METHOD AND APPARATUS FOR FORMING A PACKAGE WITH PROTECTED SEAL

(71) Applicant: MULTIVAC SEPP HAGGENMUELLER SE & CO. KG, Wolfertschwenden (DE)

(72) Inventors: Cem H. Yildirim, Parkville, MO (US); Christian J. Uebele, Kansas City, MO (US)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 0 days.

(21) Appl. No.: 17/244,325

(22) Filed: Apr. 29, 2021

(65) Prior Publication Data

US 2022/0348364 A1 Nov. 3, 2022

(51) Int. Cl.

| | |
|---|---|
| ***B65B 9/04*** | (2006.01) |
| ***B65B 61/06*** | (2006.01) |
| ***B65B 7/16*** | (2006.01) |

(52) U.S. Cl.

CPC ..... *B65B 9/04* (2013.01); *B65B 7/164* (2013.01); *B65B 7/168* (2013.01); *B65B 61/06* (2013.01)

(58) Field of Classification Search

CPC ..... B65B 7/162; B65B 7/164; B65B 7/168; B65B 9/04; B65B 61/005; B65B 61/06; B65D 51/185; B65D 77/2048; B65D 77/206; B65D 2577/2091; B65D 75/326; B65D 51/18

USPC ..... 53/453, 559, 477, 478, 282, 286, 329.4

See application file for complete search history.

(56) References Cited

U.S. PATENT DOCUMENTS

| | | | | |
|---|---|---|---|---|
| 3,366,309 | A * | 1/1968 | Scharre | B65D 77/2008 426/123 |
| 8,012,294 | B2 | 9/2011 | Austermeier | |
| 9,914,576 | B2 * | 3/2018 | Konicke | B65D 77/2096 |
| 10,457,431 | B2 * | 10/2019 | Jensen et al. | B65B 7/2842 |
| 2010/0116426 | A1 | 5/2010 | Austermeier | |
| 2014/0018220 | A1 * | 1/2014 | Wilhelm et al. | B65B 9/04 493/121 |
| 2015/0041043 | A1 | 2/2015 | Austermeier et al. | |
| 2022/0185564 | A1 | 6/2022 | Murphy | |

FOREIGN PATENT DOCUMENTS

| | | | | |
|---|---|---|---|---|
| DE | 102011118533 | A1 * | 5/2013 | B65B 7/164 |
| DE | 10 2013 013 077 | A1 | 2/2015 | |
| EP | 611695 | A1 * | 8/1994 | B65B 9/042 |

* cited by examiner

*Primary Examiner* — Stephen F. Gerrity

(74) *Attorney, Agent, or Firm* — Brooks Kushman P.C.

(57) ABSTRACT

A method of forming a package includes forming, at a forming station of a packaging machine, a package base in a film so that the package base has a pocket. The method further includes attaching, at a first cover application station of the packaging machine, a first cover layer on the package base so that the first cover layer partially covers the pocket, and so that access to the pocket is provided to position a product in the pocket after the first cover layer has been attached to the package base.

24 Claims, 6 Drawing Sheets

METHOD AND APPARATUS FOR FORMING A PACKAGE WITH PROTECTED SEAL

TECHNICAL FIELD

The disclosure relates to a method and apparatus for forming a package.

BACKGROUND

A prior method of making a package involves thermoforming a package base, filling the package base with a product, and sealing a cover layer on the package base to form a sealed package. With such a method, product may be trapped between an edge of the package base and the cover layer, thereby resulting in a defective package.

SUMMARY

An object of the present disclosure is to provide an improved method and apparatus for making a package that may reduce product presence between a cover layer and an edge or flange of a package base.

A method according to the disclosure of forming a package may include forming, at a forming station of a packaging machine, a package base in a film so that the package base has a pocket. The method may further include attaching, at a first cover application station of the packaging machine, a first cover layer on the package base so that the first cover layer partially covers the pocket, and so that access to the pocket is provided to position a product in the pocket after the first cover layer has been attached to the package base.

A packaging machine according to the disclosure may comprise a forming station configured to form a package base in a film so that the package base has a pocket. The packaging machine may further include a cover application station configured to attach a cover layer on the package base so that the cover layer partially covers the pocket and so that access to the pocket is provided for positioning a product in the pocket after the cover layer has been attached to the package base.

A packaging machine according to at least one embodiment of the disclosure may comprise a forming station configured to form a package base in a film so that the package base has a pocket, and a first cover application station configured to attach a first cover layer on the package base so that the first cover layer partially covers the pocket. The first cover application station may include a sealing tool or a press to attach the first cover layer on the package base. The packaging machine may further include a loading station for loading a product into the pocket after the first cover layer has been attached to the package base, and a second cover application station disposed downstream of the loading station and configured to attach a second cover layer on the first cover layer to substantially or completely cover the pocket. Furthermore, the second cover application station may include a sealing tool or a press to attach the second cover layer on the first cover layer.

While exemplary embodiments are illustrated and disclosed, such disclosure should not be construed to limit the claims. It is anticipated that various modifications and alternative designs may be made without departing from the scope of the disclosure.

DETAILED DESCRIPTION

As required, detailed embodiments are disclosed herein; however, it is to be understood that the disclosed embodiments are merely exemplary, and that various and alternative forms may be employed. The figures are not necessarily to scale. Some features may be exaggerated or minimized to show details of particular components. Therefore, specific structural and functional details disclosed herein are not to be interpreted as limiting, but merely as a representative basis for teaching one skilled in the art.

Figure 1:
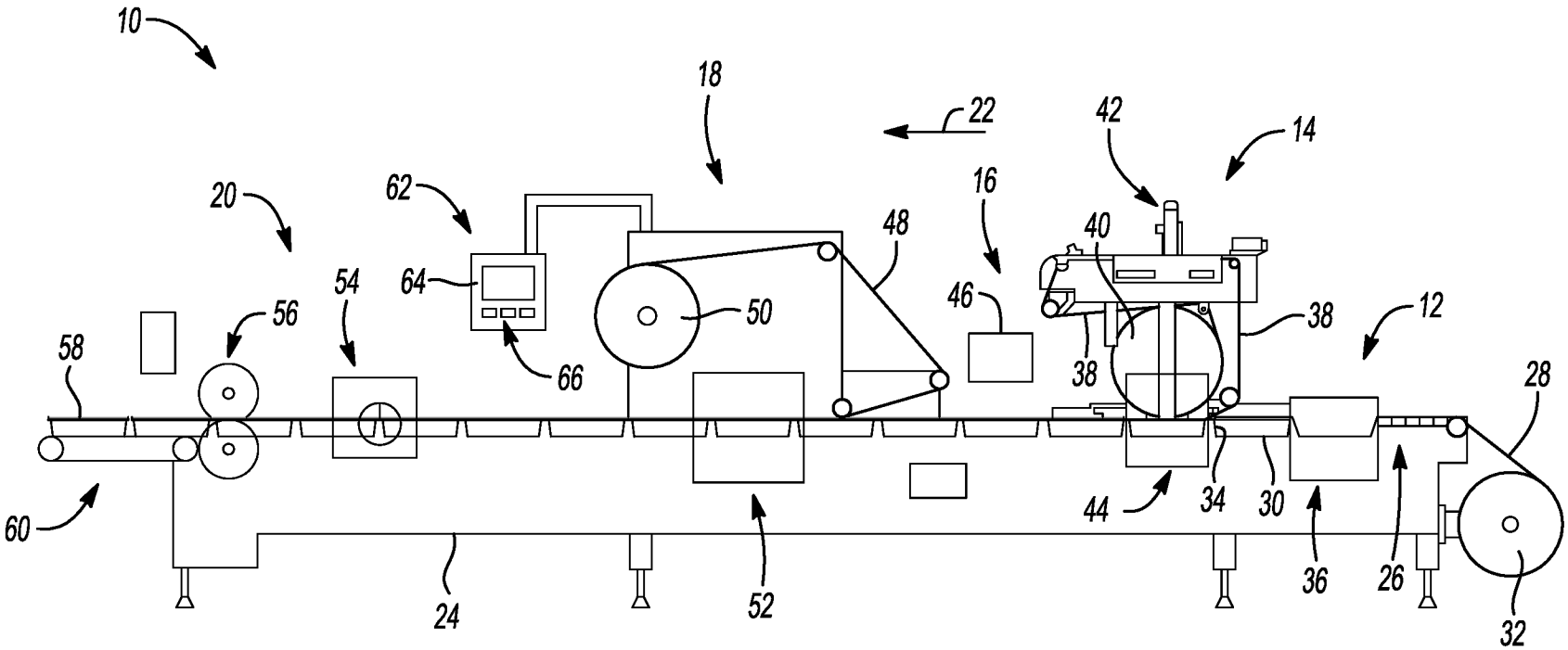
FIG. 1 is a schematic side view of a packaging machine according to the present disclosure for making packages, wherein the packaging machine includes a forming station for forming package bases in a film so that each package base defines a pocket for receiving one or more products, a first cover application station for attaching a first cover layer to the package bases to partially cover the pockets, a loading station for loading products into the pockets, a second cover application station for attaching a second cover layer to the first cover layer to cover the pockets, and a cutting station for separating completed packages from each other.

FIG. 1 shows a packaging machine 10 according to the present disclosure for making packages containing products. The packaging machine 10 includes multiple work stations, such as a forming station 12, a first cover application station 14, a loading station 16 (e.g., loading area or zone), a second cover application station 18, and a cutting station 20 arranged in that order in a direction of production or transport 22 on a machine frame 24. In the embodiment shown in FIG. 1, the packaging machine 10 further includes a conveyor device or transport device 26 (only a portion of which is shown in FIG. 1) for gripping and transporting a base film 28 along the machine frame 24 from station to station in the direction of transport 22. The transport device 26 may be any suitable device, such as a circulatable chain drive device or belt drive device having one or more transport members, such as right and left chains or belts, with multiple gripper members, such as clamps, configured to grip the base film 28.

The forming station 12 is configured or operable to form one or more package bases 30 (e.g., trays or troughs) in the base film 28, which may be supplied from (e.g., drawn off) a supply roll 32 positioned at an inlet side of the machine frame 24, so that each package base 30 has a pocket 34 for receiving one or more products. For example, the forming station 12 may include a mold 36 in which one or more package bases 30 may be formed by use of compressed air and/or vacuum to force and/or draw the film 28 downwardly into the mold 36. The mold 36 may be configured to form a single package base 30 during each mold cycle, or the mold 36 may be configured so that multiple package bases 30 may be formed adjacent to one another in a direction perpendicular to the direction of transport 22 and/or so that multiple package bases 30 may be formed adjacent to one another in the direction of transport 22 (e.g., two or more rows of two or more packages in each row).

The first cover application station 14 is configured or operable to attach a first cover layer 38 on each package base 30 so that the first cover layer 38 only partially covers the pocket 34 of each package base 30. For example, the first cover layer 38 may cover less than 60%, or less than 50%, or less than 30%, or less than 20% of each pocket 34, when viewed from above. As a result, access to each pocket 34 is provided for positioning one or more products in the pocket 34 after the first cover layer 38 has been attached to the respective package base 30.

Figure 2:
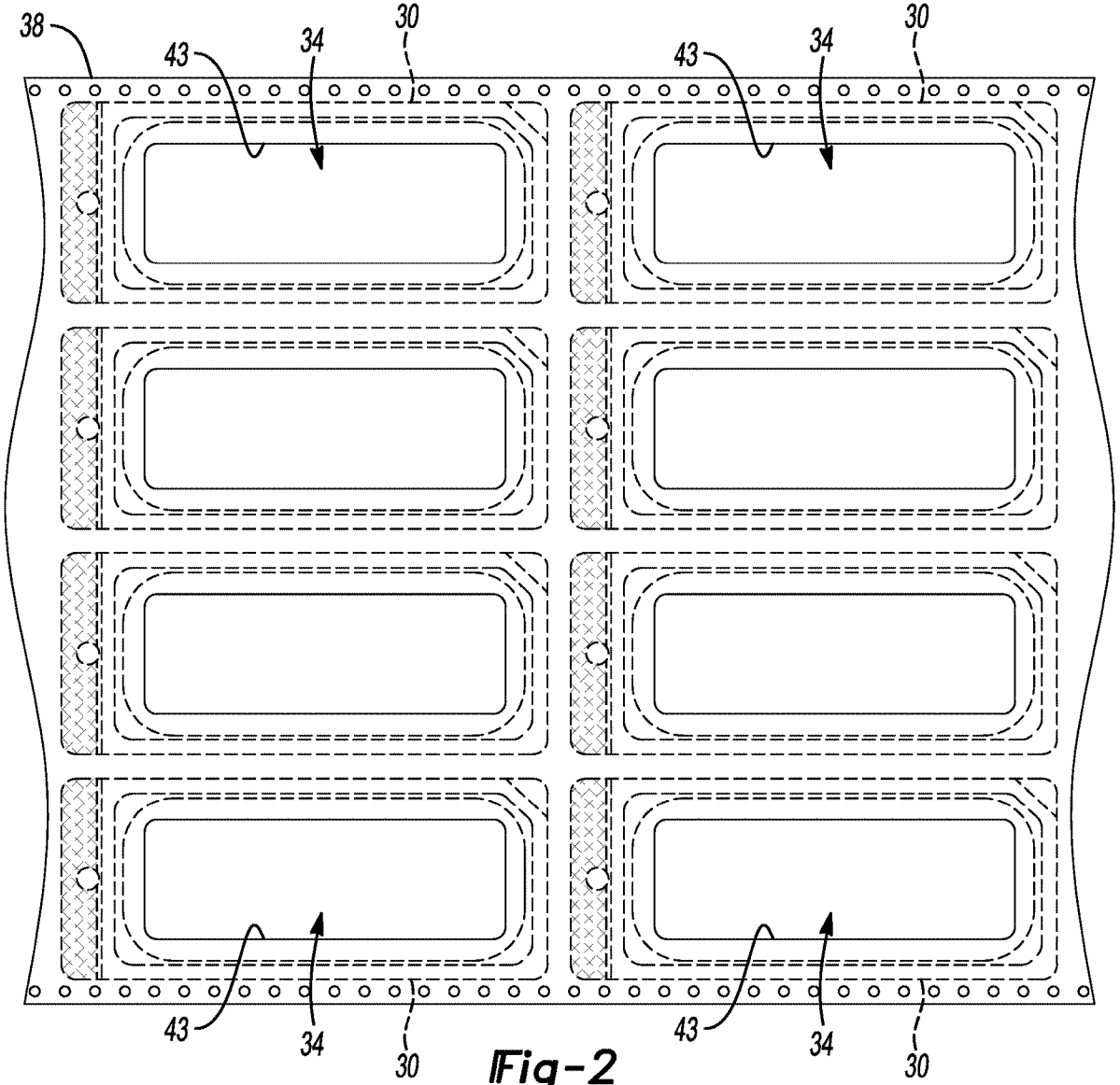
FIG. 2 is a top view of partially completed packages that each include a package base and a continuous first cover layer that partially covers the pockets of the package bases.

While the first cover application station 14 may have any suitable configuration, in the embodiment shown in FIG. 1, the first cover application station 14 comprises a supply of first cover material, such as a heat sealable layer (e.g., plastic film) or a double-sided heat sealable layer (e.g., plastic film), provided as a roll 40 of the first cover layer 38, and a cutting device 42, such as a punch, stamp, knife, or knife assembly, for cutting openings 43 (see FIG. 2) in the first cover layer 38. The first cover application station 14 further includes a first cover application device, such as a first heat sealing device or die 44 (e.g., a sealing tool having upper and lower sealing tool parts that cooperate or interact, such as by moving one sealing tool part toward the other sealing tool part, to perform a sealing function with pressure and heat), disposed downstream of the cutting device 42 with respect to a direction of movement of the first cover layer 38 in the first cover application station 14. The first cover application device is configured to attach the first cover layer 38 to each package base 30 so that one of the openings 43 is positioned above the pocket 34 of each package base 30, as shown in FIG. 2, and so that access to the pocket 34 is provided through the opening 43.

The loading station 16 is arranged in the direction of transport 22 downstream of the first cover application station 14 for loading or depositing one or more products, such as food products like vegetables (e.g., herbs, lettuce, etc.), into each pocket 34 after the first cover layer 38 has been attached to the respective package base 30. The products may be manually loaded into the pockets 34 of the package bases 30, or the loading station 16 may include an automatic loading or depositor device 46, such as a movable gripper arm or a funnel, that is operable to load the one or more products into each pocket 34. The depositor device may also include a tamper for tamping down the products after they are loaded.

The second cover application station 18 is disposed in the direction of transport 22 downstream of the loading area 16 and is configured or operable to apply a second cover layer 48 on the first cover layer 38 to completely cover each pocket 34, or substantially cover each pocket 34 (e.g., cover at least 85% or at least 90% or at least 95% of each pocket 34), after the pocket 34 has been loaded with the one or more products. For example, the second cover layer 48 may completely cover the first cover layer 38, or it may partially cover the first cover layer 38 so that each opening 43 in the first cover layer 38 is completely covered. As another example, the second cover layer 48 may cooperate with the first cover layer 38 to substantially cover each pocket 34 if, for example, the second cover layer 48 has small openings (e.g., micro-perforations) to allow air to pass through the second cover layer 48. While the second cover application station 18 may have any suitable configuration, in the embodiment shown in FIG. 1, the second cover application station 18 comprises a supply of second cover material, such as a heat sealable plastic film, provided as a roll 50 of the second cover layer 48, and a second cover application device, such as a second heat sealing device or die 52, configured to attach the second cover layer 48 on each package base 30, and in particular on the first cover layer 38, so that the first and second cover layers 38, 48 cooperate to completely cover, or substantially cover, each pocket 34 of each package base 30. Furthermore, the second heat sealing die 52 may be any suitable device, such as a sealing tool having upper and lower sealing tool parts that cooperate or interact, such as by moving one sealing tool part toward the other sealing tool part, to perform a sealing function with pressure and heat.

The cutting station 20 is disposed in the direction of transport 22 downstream of the second cover application station 18 and may include one or more cutting devices for cutting the base film 28, the first cover layer 38 and the second cover layer 48 between adjacent package bases 30 to separate completed packages. For example, the cutting station 20 may include a transverse cutting device 54, such as one or more cutting blades, for severing the base film 28, the first cover layer 38 and the second cover layer 48 in a direction transverse to the direction of transport 22 in such a manner that the base film 28 is not severed across its entire width so that the base film 28 is not severed at least at one edge region. This enables controlled onward movement of the package bases 30 beyond the transverse cutting device 54 by the transport device 26.

Figure 3A:
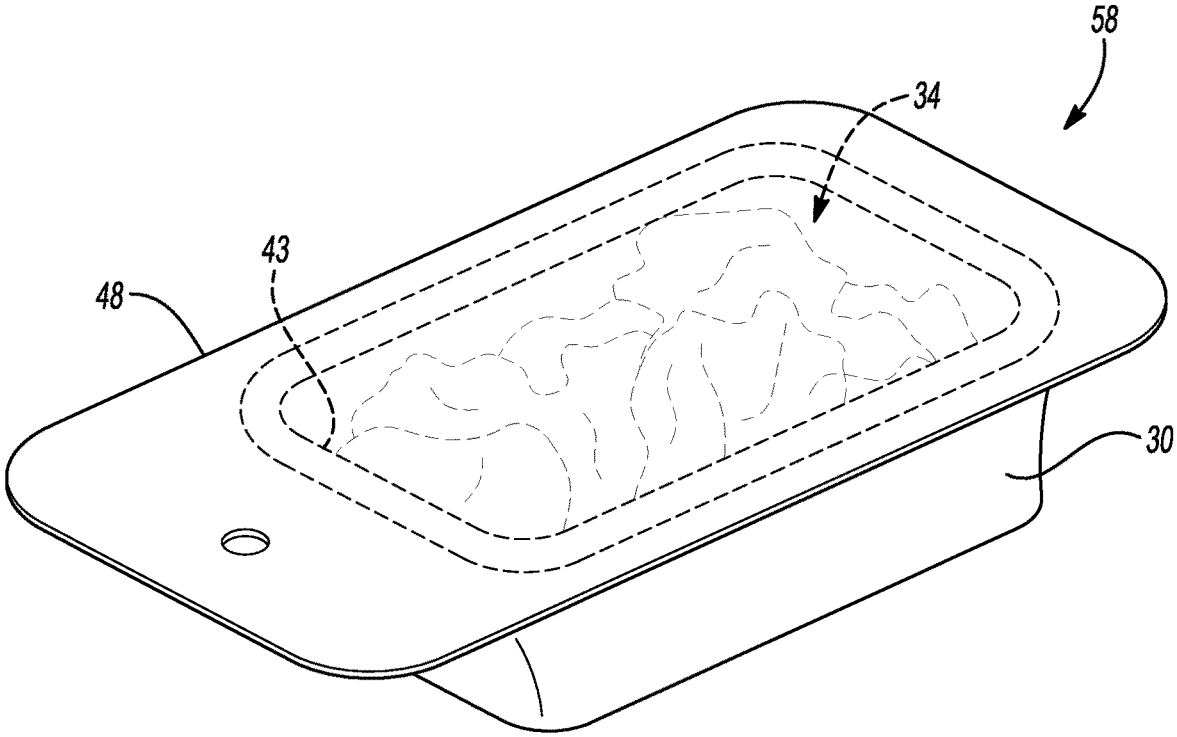
FIG. 3A is a perspective view of a completed package including a package base with a pocket, a first cover layer having an opening positioned above the pocket, and a second cover layer attached to the first cover layer for covering the opening in the first cover layer.
Figure 3B:
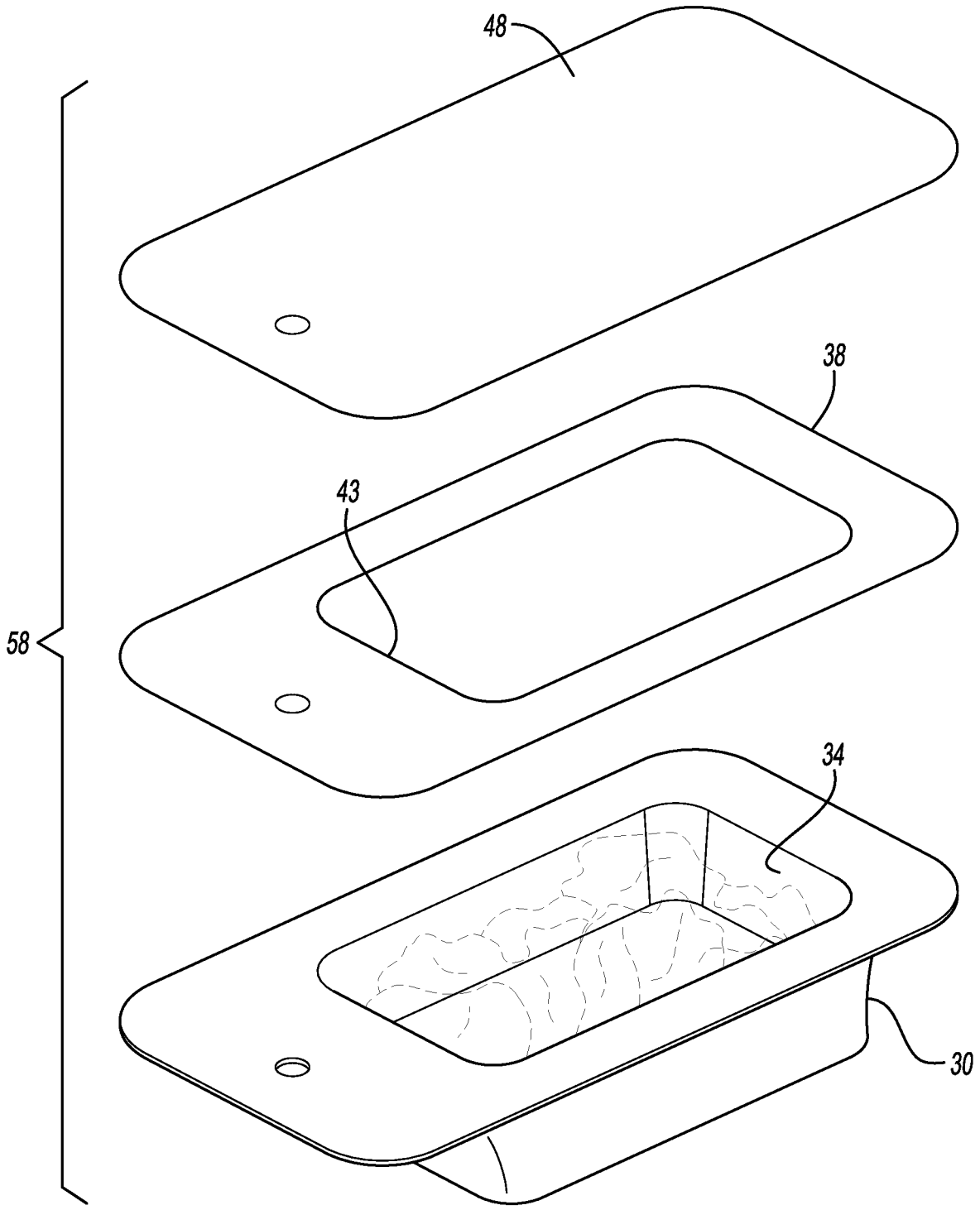
FIG. 3B shows an exploded perspective view of the package of FIG. 3A with the cover layers and the package base separated from each other.

The cutting station 20 may further include a longitudinal cutting device 56, such as one or more cutting blades, for severing the base film 28, the first cover layer 38 and the second cover layer 48 between adjacent package bases 30 in the direction of transport 22 so that completely separated packages 58 are present downstream of the longitudinal cutting device 56. Furthermore, the completely separated packages 58 may be transported away from the packaging machine 10 on a conveyor device 60, for example. FIG. 3A shows a completed package 58 in perspective view, and FIG. 3B shows the package 58 in an exploded perspective view with the cut cover layers 38 and 48 and cut package base 30 separated from each other.

Referring to FIG. 1, the packaging machine 10 also comprises a control system or unit 62 for controlling and/or monitoring operation of the various work stations 12, 14, 16, 18 and 20. The control unit 62 may include a display device 64 for displaying various operating and/or control parameters of the work stations, and control elements 66 for inputting control parameters or otherwise influencing processes at the work stations. Furthermore, the control unit 62 may include any suitable hardware and/or software for controlling and/or monitoring operation of the work stations 12, 14, 16, 18 and 20 (e.g., for performing the particular algorithms represented by the functions described herein). For example, the control unit 62 may include one or more processors in communication with one or more storage devices or memory units, which include computer readable program instructions that are executable by the one or more processors so that the control unit 62 may control and/or monitor operation of the work stations 12, 14, 16, 18 and 20, as well as other components of the packaging machine 10. The control unit 62 may also, or instead, include one or more application specific integrated circuits, programmable gate arrays, programmable logic devices, and/or digital signal processors.

Referring to FIGS. 1 and 2, a method of forming a package 58 using the packaging machine 10 will now be described in more detail. First, the base film 28 may be gripped by the transport device 26 and transported to the forming station 12, where one or more package bases 30 may be formed in the base film 28, such as by thermoforming, so that each package base 30 has a pocket 34. Referring to FIG. 2, for example, multiple rows of package bases 30 (e.g., two or more rows, such as four rows) with multiple package bases 30 per row (e.g., two or more package bases 30 per row) may be formed in each work cycle of the forming station 12.

Next, the base film 28 may be advanced by a certain distance in an advancement cycle of the packaging machine 10 in order to transport the one or more package bases 30 from the forming station 12 to the first cover application station 14. At the first cover application station 14, the first cover layer 38 may be attached to each package base 30 so that, for each package base 30, the first cover layer 38 may be attached along an entire circumferential flange or rim of the package base 30 that surrounds the respective pocket 34, and so that an opening 43 of the first cover layer 38 is positioned above the respective pocket 34. For example, prior to the advancement cycle mentioned above, the cutting device 42 may cut one or more openings 43 in the first cover layer 38 so that when the first cover layer 38 is advanced along with the base film 28 into the first heat sealing device 44, such as by movement of the transport device 26, the one or more openings 43 will each be aligned with a pocket 34 of a respective package base 30. Then, the sealing device 44 may be used to heat seal the first cover layer 38 onto the one or more package bases 30.

The base film 28 and the first cover layer 38 may then be advanced by a certain distance in an additional advancement cycle of the packaging machine 10 in order to transport the one or more package bases 30 from the first cover application station 14 to the loading station 16, so that one or more products may be manually or automatically loaded into the pocket 34 of each package base 30. Because the rim of each package base 30 may be completely or substantially covered by the first cover layer 38, products may be prevented from getting trapped between the first cover layer 38 and the rims of the package bases 30. Furthermore, for each package base 30, because the first cover layer 38 may extend inwardly of the respective rim, the first cover layer 38 may help to retain the products in the package bases 30.

Next, the base film 28 and the first cover layer 38 may be advanced again by a certain distance in another advancement cycle of the packaging machine 10 in order to transport the one or more package bases 30, with the products loaded therein, and the first cover layer 38 attached to the one or more package bases 30 from the loading station 16 to the second cover application station 18. There, the second cover layer 48 may be attached to the first cover layer 38, such as by the second heat sealing device 52, so that the second cover layer 48 covers each opening 43 and so that each pocket 34 is substantially covered or completely covered (e.g., to form air-tight packages). Packages may also be evacuated and/or gassed prior to or during attachment of the second cover layer 48.

If both the first and second cover layers 38, 48 are formed as heat sealable layers, the first cover layer 38 may be a double-sided heat sealable layer, as mentioned previously. In such a case, the bottom surface of the first cover layer 38 may be activatable at a lower sealing temperature than the top surface of the first cover layer 38, so that the first cover layer 38 may be attached to package bases 30 at the first sealing station 14 without activating the top surface of the first cover layer 38. After products are loaded into the package bases 30, the second cover layer 48 may then be sealed to the first cover layer 38 at the second cover application station 18 using a higher sealing temperature to activate the top surface of the first cover layer 38. For example, the bottom surface of the first cover layer 38 may be activatable at a sealing temperature at or below 150° C. (e.g., 120-150° C.), and the top surface of the first cover layer 38 may be activatable at a sealing temperature at or above 160° C. (e.g., 160-200° C.).

The base film 28 with the first and second cover layers 38 and 48, respectively, attached thereto may then be advanced to the cutting station 20, where the base film 28 and the first and second cover layers 38 and 48, respectively, may be severed to separate adjacent package bases 30 and form completely separated packages 58. For example, as mentioned above, the transverse cutting device 54 may first sever the base film 28, the first cover layer 38 and the second cover layer 48 in a direction transverse to the direction of transport 22 in such a manner that the base film 28 is not severed across its entire width so that the base film 28 is not severed at least at one edge region. This enables controlled onward movement of the package bases 30 by the transport device 26 to the longitudinal cutting device 56, which is configured to sever the base film 28, the first cover layer 38 and the second cover layer 48 between adjacent package bases 30 in the direction of transport 22 so that completely separated packages 58 are present downstream of the longitudinal cutting device 56. As also mentioned above, the separated packages 58 may then be transported away from the packaging machine 10 on the conveyor device 60 for further processing or distribution.

It should be noted that the packaging machine 10 and corresponding method may be modified in many ways. For example, the first cover layer provided at the first cover application station 14 may be a self-adhesive layer or an adhesive-backed layer (e.g., an adhesive-backed plastic film or paper layer), rather than a heat sealable layer, and the first cover layer may be provided on a carrier layer, such as a carrier film. Furthermore, the first cover layer may be separated from the carrier layer prior to attachment of the first cover layer onto the package bases 30. For example, the first cover application station 14 may include a dispensing device, such as a dispensing edge, for separating or removing the first cover layer from the carrier layer. Moreover, the first cover application device may be a movable press, such as a pressure plate, configured to press the first cover layer onto each package base 30 after the first cover layer has been separated from the carrier layer, if included.

As another example, the first cover application station 14 may include a supply of first cover material, such as a heat sealable layer (e.g., plastic film) or adhesive-backed layer (e.g., plastic film or paper layer provided on a carrier layer), provided as a roll of the first cover layer having multiple openings preformed therein. With such a configuration, the cutting device 42 may not be needed.

Figure 4:
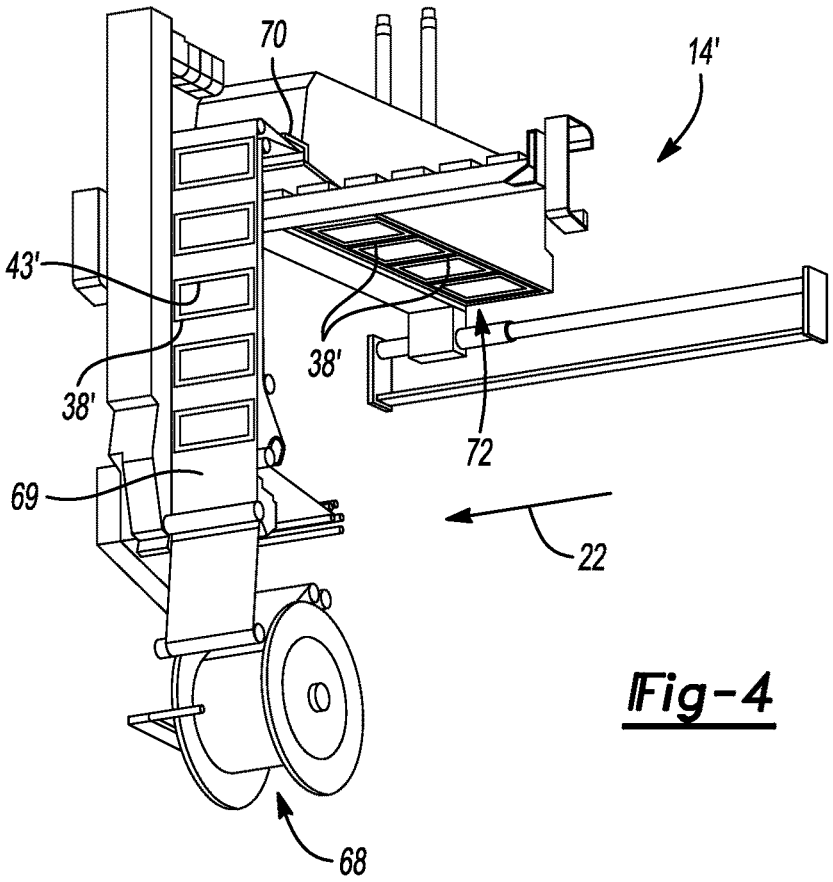
FIG. 4 is a perspective view of another embodiment of a first cover application station for use with the packaging machine shown in FIG. 1.

FIG. 4 shows another example of a first cover application station 14' for use with the packaging machine 10 and configured to attach individual first cover layers onto each package base 30. The first cover application station 14' may include a supply of first cover material provided as a roll 68 of preformed first cover layers 38' (e.g., adhesive-backed plastic or paper cover members, such as labels) provided on a carrier layer or strip 69 and that each have an opening 43' preformed therein. Furthermore, the first cover application station 14' may include a dispensing device 70, such as a dispensing edge, configured to separate or remove the first cover layers 38' from the carrier strip 69, and the first cover application device of the first cover application station 14' may include one or more depositor devices 72, such as movable presses or pusher plates, that are configured to apply (e.g., press) each first cover layer 38' onto a respective package base 30. For example, the first cover layers 38' may be separated from the carrier strip 69 by the dispensing device 70 and transferred (e.g., by movable bands that are movable in a direction transverse to the direction of transport 22) to the depositor device or devices 72, which may extend laterally over the package bases 30 in a direction transverse to the direction of transport 22. Each depositor device 72 may then be moved downwardly toward the package bases 30 to apply the first cover layers 38' on the package bases 30. If the first cover application station 14' includes multiple depositor devices 72, the depositor devices may be configured to move independently, such as with independent drives, and each depositor device 72 may be configured to receive one or more first cover layers 38'. In the embodiment shown in FIG. 4, the first cover application station 14' includes one depositor device 72 that is configured to receive four first cover layers 38', which may be held in place by a vacuum, for example, until the depositor device 72 is moved toward and pressed against the package bases 30 to apply the first cover layers 38' on the package bases 30. In another embodiment, the first cover application station 14' may include two or more depositor devices 72 arranged in the direction of transport 22 next to each other, wherein each depositor device 72 is configured to receive and apply one or more first cover layers 38' (e.g., four first cover layers 38') to a corresponding number of package bases 30 (e.g., four package bases 30) so that the first cover application station 14' may apply first cover layers 38' to the same number of package bases 30 (e.g., eight, as shown in FIG. 2) that are formed in each cycle of the forming station 12. Additional details of similar cover application devices (e.g., label applicators) are disclosed in U.S. Patent Application Publication No. 2015/0041043 A1 and U.S. Pat. No. 8,012,294 B2, which are hereby incorporated by reference herein.

Figure 5:
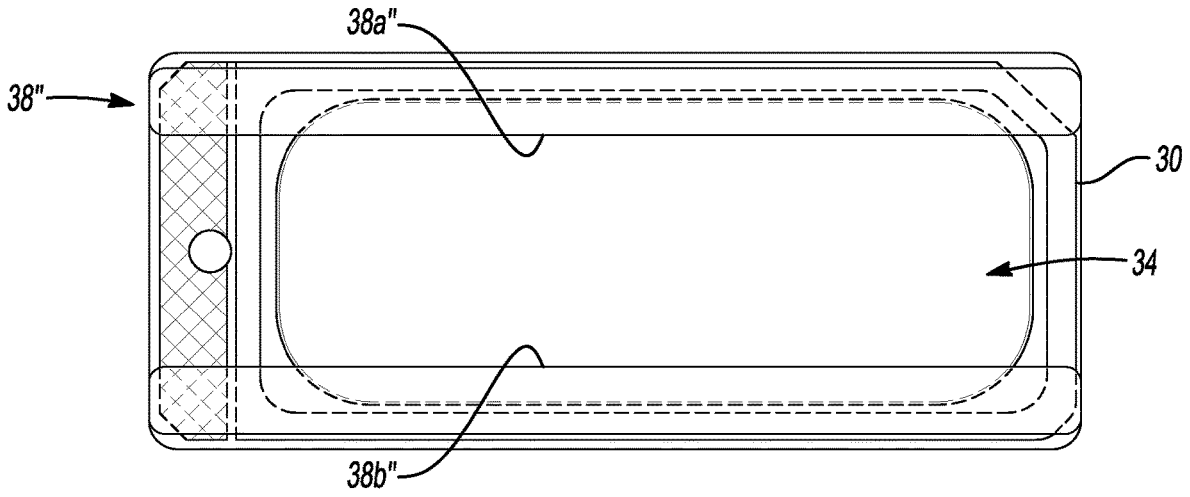
FIG. 5 is a top view of another embodiment of a partially completed package produced by a packaging machine according to the disclosure, wherein the partially completed package includes a package base that defines a pocket, and a first cover layer formed as first and second elongated strips attached to the package base so that the first and second elongated strips partially cover the pocket.

As yet another example, the first cover application station 14, 14' may be configured to attach any suitable first cover layer, such as one or more strips of material (e.g., plastic film or paper), onto each package base 30 so that each corresponding pocket 34 is only partially covered by the first cover layer. FIG. 5 shows an example in which a first cover layer 38" comprises two strips 38*a*" and 38*b*" of material (e.g., heat sealable or adhesively-backed plastic film or paper) attached to a package base 30, such as through a heat sealing process or press process. In the embodiment shown in FIG. 5, each strip 38*a*", 38*b*" of material covers a longitudinally extending side edge or flange of the package base 30, but the end edges of the package base 30 are not fully covered. Furthermore, the strips 38*a*", 38*b*" of material may each be provided as a continuous roll of material (e.g., elongated strip of material) at the first cover application station 14, 14', or as individual strips provided on a carrier layer, for example, and the strips 38*a*", 38*b*" may be heat-sealed or adhesively attached to the package base 30 at the first cover application station 14, 14'. For example, the first cover application device may comprise a first heat sealing device or die having one elongated sealing bar for each strip 38*a*", 38*b*", or the first cover application device may comprise a press or pusher plate for each strip 38*a*", 38*b*".

Likewise, the second cover layer at the second cover application station 18 may be a self-adhesive layer or an adhesive-backed layer (e.g., an adhesive-backed plastic film or paper layer), rather than a heat sealable layer, and the second cover layer may be provided on a carrier layer, such as a carrier film, that may be separated from the second cover layer prior to attachment of the second cover layer onto the first cover layer or layers 38 and the package bases 30. For example, the second cover application station 18 may include a dispensing device, such as a dispensing edge, for separating the second cover layer from the carrier layer, and the second cover application device may be a movable press, such as a pressure plate, configured to press the second cover layer onto each first cover layer and respective package base 30.

As another example, the second cover application station 18 may have a similar configuration as the configuration shown in FIG. 4 for the first cover application station 14'. In that regard, the second cover application station 18 may include a supply of second cover material provided as a roll of preformed second cover layers (e.g., adhesive-backed plastic or paper cover members, such as labels) provided on a carrier strip. Furthermore, the second cover application device may include a dispensing device configured to remove the second cover layers from the carrier strip, and one or more depositor devices, such as movable presses or pusher plates, that are configured to press each second cover layer onto each respective first cover layer 38, 38' attached to a respective package base 30. Such second cover layers may be provided without any openings formed therein so that each second cover layer completely covers a pocket 34 of a respective package base, or the second cover layers may each be provided with one or more small openings (e.g., micro-perforations), to allow passage of air for example, so that each second cover layer substantially covers a pocket 34 of a respective package base 30.

It should also be noted that the above features may be combined in any suitable manner to form additional embodiments according to the disclosure. For example, a packaging machine according to the disclosure may include a first cover application station formed as the first cover application station 14', and a second cover application station provided with a similar configuration, so that neither the first cover application station nor the second cover application station includes a heat sealing device. As another example, a packaging machine according to the disclosure may include a first cover application station formed as the first cover application station 14', and a second cover application station like the second cover application station 18 including a heat sealing device 52.

Figure 6:
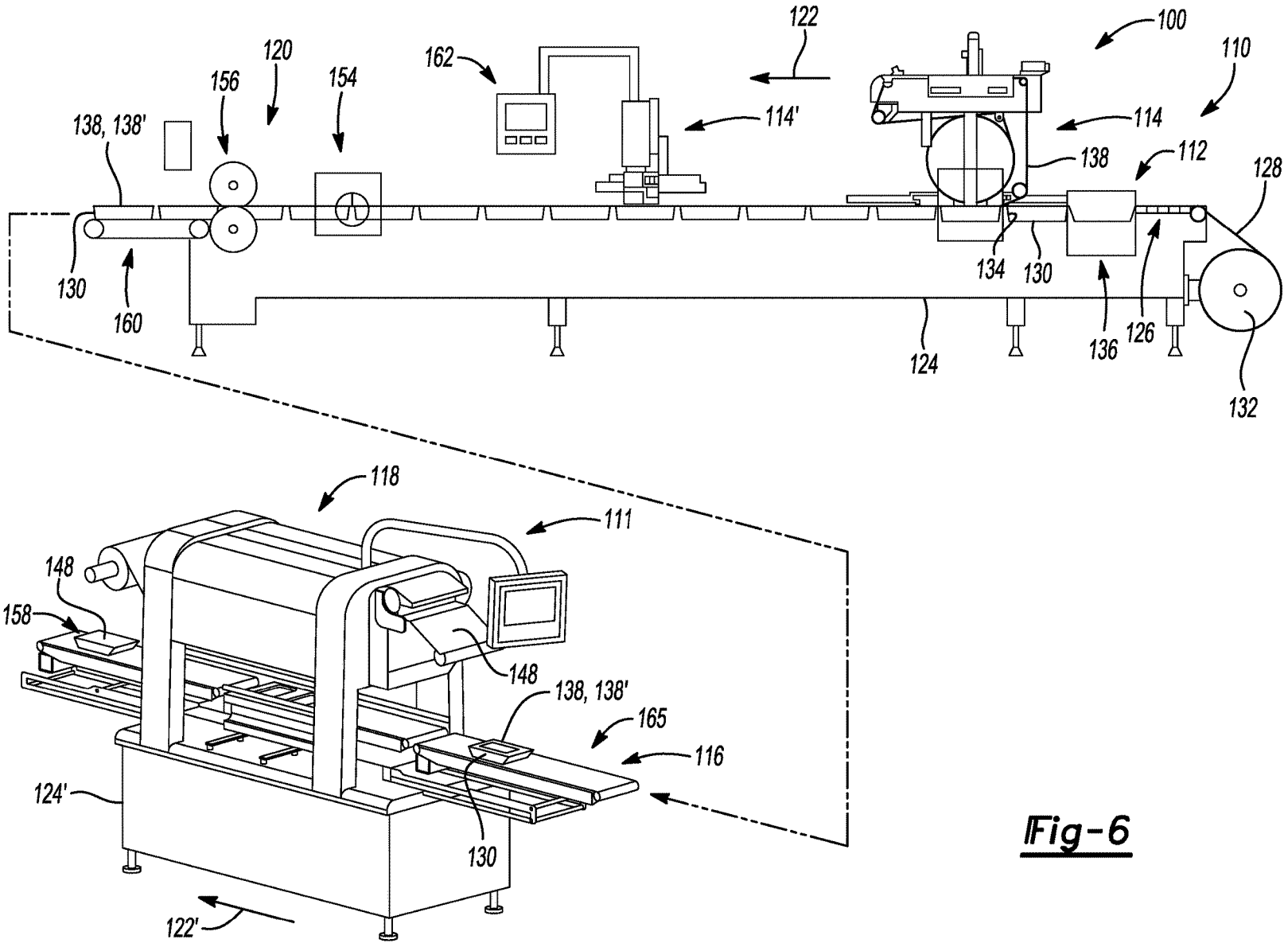
FIG. 6 shows a packaging arrangement according to the disclosure for making packages, wherein the packaging arrangement includes a first packaging machine shown in schematic side view and a second packaging machine shown in perspective view and arranged proximate a discharge end of the first packaging machine, the first packaging machine including a forming station, a first cover application station, an alternative first cover application station, and a cutting station for separating partially completed packages from each other, and the second packaging machine including a loading station and a second cover application station.

FIG. 6 shows another embodiment of a packaging machine arrangement 100, according to the disclosure, for making packages containing products. The packaging arrangement 100 includes one or more packaging machines positioned proximate each other, such as within the same plant or facility (e.g., within 100 feet or 50 feet or 25 feet of each other). In the embodiment shown in FIG. 6, the packaging arrangement 100 includes a first packaging machine 110, such as a thermoforming packaging machine, and a second packaging machine 111, such as a tray sealer, positioned proximate an outlet end of the first packaging machine 110.

The first packaging machine 110 includes various work stations that may be similar to those of the packaging machine 10, and those similar work stations are identified with similar reference numbers increased by 100. In that regard, the first packaging machine 110 includes a forming station 112, a first cover application station 114, and a cutting station 120 arranged in that order in a direction of production or transport 122 on a machine frame 124. The first packaging machine 110 also includes an alternative first cover application station 114' disposed upstream of the cutting station 120 and that may function in a similar manner as the above described first cover application station 14'. With such a configuration, the first packaging machine 110 may be used to attach either a first cover layer 138 (e.g., heat-sealable layer) with the first cover application station 114 or a first cover layer 138' (e.g., adhesive-backed layer) with the first cover application station 114' to each package base 130 formed in the forming station 112.

The second packaging machine 111 likewise may include one or more work stations that are similar to those of the packaging machine 10, and again those similar workstations are identified with similar reference numbers increased by 100. Specifically, the second packaging machine 111 may include a loading station 116 (e.g., loading area or zone) and a second cover application station 118 arranged in that order in a direction of production or transport 122' on a machine frame 124'. Alternatively, the loading station 116 may be provided as a separate work station between the first packaging machine 110 and the second packaging machine 111.

The packaging machine arrangement 100 may be operated in a similar manner as the packaging machine 10. With the packaging machine arrangement 100, however, partially completed packages that each include a package base 130 having a pocket 134, and a first cover layer 138 or 138' attached to the package base 130 and that only partially covers the pocket 134 may be produced at the first packaging machine 110. Furthermore, because the first packaging machine 110 includes the cutting station 120, the partially completed packages may be completely separated from each other upon exiting the first packaging machine 110. Those partially completed packages may then be transported manually or automatically, such as by a conveyor device 160, away from the cutting station 120. The conveyor device 160 may also move the partially completed packages to or toward the second packaging machine 111, or to or toward an intermediate location if the loading station 116 is provided separate from the second packaging machine 111, for example.

Products may then be loaded into the pockets 134 of the package bases 130 in a similar manner as described above with respect to the packaging machine 10, e.g., manually or automatically, at the loading station 116. Next, the loaded package bases 130 may be moved by a conveyor device 165 to the second cover application station 118 of the second packaging machine 111, where a second cover layer 148 may be attached to each package base 130, particularly to the first cover layer 138 attached to each package base 130, to substantially or completely cover the respective pocket 134 and thereby form a completed package 158. Alternatively, if the loading station 16 is provided separate from the first packaging machine 110 and the second packaging machine 111, the partially completed packages may be transferred manually or automatically, such as by a conveyor, from the first packaging machine 110 to the loading station 16 where products may be loaded into the pockets 134 of the package bases 130. The loaded package bases 130 may then be moved manually or automatically to the second cover application station 118 of the second packaging machine 111, where a second cover layer 148 may be attached to each package base 130.

Various stations of the packaging machine arrangement 100 may be modified in a similar manner as described above with respect to the packaging machine 10. For example, the first cover application station 118 and/or the second cover application station 120 may be modified as described above with respect to the first cover application station and/or the second cover application station of the packaging machine 10.

In another embodiment, a packaging machine arrangement according to the present disclosure may include first and second packaging machines positioned proximate each other and that are each configured to apply a cover layer onto preformed package bases. The first packaging machine may include a first cover application station configured to attach a first cover layer onto each of multiple preformed package bases that each have a pocket, so that again the first cover layer partially covers the pocket. For example, the first cover application station may include any suitable cover application device and each first cover layer may have any suitable configuration, such as described above with respect to the packaging machine 10 and/or the packaging machine arrangement 100. Each pocket may then be filled with one or more products at the first packaging machine or second packaging machine, or at an intermediate location between the packaging machines. Next, the loaded package bases may be moved manually or automatically, such as by a conveyor device, to a second cover application station of the second packaging machine, where a second cover layer may be attached to each package base, particularly to the first cover layer attached to each package base, to substantially or completely cover the respective pocket and thereby form a completed package. For example, the second cover application station may include any suitable cover application device and each second cover layer may have any suitable configuration, such as described above with respect to the packaging machine 10 and/or the packaging machine arrangement 100.

With any of the above-described embodiments, package quality may be improved compared to packages produced by prior packaging machines. In that regard, because edge portions or flange portions or the entire circumferential edge, flange or rim of each package base may be covered by a first cover layer prior to loading one or more products into the package base, product entrapment between the package base and the first cover layer or subsequent cover layer (e.g., second cover layer) may be significantly inhibited or eliminated. As a result, attachment quality (e.g., seal quality) between the first cover layer or subsequent cover layer and the package base may be significantly improved compared to a package with a single cover layer. Furthermore, because the first cover layer may partially extend over the pocket of the package base (i.e., inwardly of the flange or rim of the package base), the first cover layer may function to help keep products retained below the first cover layer prior to attachment of the second cover layer, which may be particularly helpful with springy products such as herbs or other leafy greens, for example. As a result, the package base may be made with a shallower height as compared to prior package bases for the same type of product. Furthermore, the second cover layer may be configured to be peelable off the first cover layer and resealable onto the first cover layer during use of the package.

While exemplary embodiments are described above, it is not intended that these embodiments describe all possible forms according to the disclosure. In that regard, the words used in the specification are words of description rather than limitation, and it is understood that various changes may be made without departing from the spirit and scope of the disclosure. Additionally, the features of various implementing embodiments may be combined to form further embodiments of the disclosure. For example, the above described packaging machine 10 may include multiple first cover application stations and/or multiple second cover application stations that may be used alternatively to apply one of multiple types of first covers and/or one of multiple types of second covers to package bases.

What is claimed is:

1. A method of forming a package, the method comprising:

forming, at a forming station of a packaging machine, a package base in a film so that the package base has a pocket; and attaching, at a first cover application station of the packaging machine, a first cover layer on the package base so that the first cover layer partially covers the pocket, and so that access to the pocket is provided to position a product in the pocket after the first cover layer has been attached to the package base;

wherein the first cover layer comprises one or more strips of material that each cover a longitudinally extending side edge of the package base when attached to the package base, and wherein the one or more strips of material do not fully cover end edges of the package base.

2. The method of claim 1, wherein the first cover application station comprises a first sealing device, and the step of attaching the first cover layer comprises sealing the first cover layer onto the package base.

3. The method of claim 2 further comprising attaching, at a second cover application station, a second cover layer to the first cover layer to substantially or completely cover the pocket after the product has been positioned in the pocket.

4. The method of claim 3, wherein the second cover application station comprises a second sealing device for sealing the second cover layer onto the first cover layer.

5. The method of claim 3, wherein the second cover layer is adhesively attached to the first cover layer at the second cover application station.

6. The method of claim 1, wherein the first cover layer is adhesively attached to the package base at the first cover application station.

7. The method of claim 6 further comprising attaching, at a second cover application station, a second cover layer to the first cover layer to substantially or completely cover the pocket after the product has been positioned in the pocket.

8. The method of claim 7, wherein the second cover layer is adhesively attached to the first cover layer at the second cover application station.

9. The method of claim 7, wherein the second cover layer is heat sealed to the first cover layer at the second cover application station.

10. The method of claim 1 further comprising attaching, at a second cover application station, a second cover layer to the first cover layer to substantially or completely cover the pocket after the product has been positioned in the pocket, wherein the second cover application station is part of the packaging machine.

11. The method of claim 1, wherein the first cover application station comprises a supply of cover material including the first cover layer and multiple additional first cover layers attached to a carrier layer, and wherein the attaching comprises separating the first cover from the carrier layer using a dispensing device, and pressing the first cover layer onto the package base.

12. The method of claim 1, wherein the one or more strips of material comprise two strips of material that are spaced apart from each other when attached to the package base.

13. The method of claim 1, wherein the one or more strips of material comprise one or more strips of plastic film.

14. The method of claim 1, wherein the one or more strips of material comprise one or more strips of paper.

15. A packaging machine comprising:

a forming station configured to form a package base in a film so that the package base has a pocket; and a cover application station configured to attach a cover layer on the package base so that the cover layer partially covers the pocket and so that access to the pocket is provided for positioning a product in the pocket after the cover layer has been attached to the package base;

wherein the cover application station comprises a supply of the cover layer, which is formed as one or more strips of material that are each configured to cover a longitudinally extending side edge of the package base in order to partially cover the pocket without fully covering end edges of the package base.

16. The packaging machine of claim 15, wherein the cover application station comprises a supply of cover material including the cover layer and multiple additional cover layers attached to a carrier layer, and the cover application station further comprises a dispensing device configured to separate the cover layer and the multiple additional cover layers from the carrier layer, and a cover application device configured to press the cover layer onto the package base.

17. The packaging machine of claim 15 further comprising a loading station for loading the product into the pocket after the cover layer has been attached to the package base, and an additional cover application station disposed downstream of the loading station and configured to attach an additional cover layer on the cover layer to substantially or completely cover the pocket after the product has been loaded into the pocket.

18. The packaging machine of claim 15, wherein the one or more strips of material comprise two strips of material, and the cover application station is configured to attach the two strips of material on the package base so that the two strips of material are spaced apart from each other.

19. The packaging machine of claim 15, wherein the one or more strips of material comprise one or more strips of plastic film.

20. The packaging machine of claim 15, wherein the one or more strips of material comprise one or more strips of paper.

21. A packaging machine arrangement comprising the packaging machine of claim 15 and an additional cover application station configured to attach an additional cover layer on the cover layer to cover the pocket after the product has been loaded into the pocket.

22. A packaging machine comprising:

a forming station configured to form a package base in a film so that the package base has a pocket;

a first cover application station configured to attach a first cover layer on the package base so that the first cover layer partially covers the pocket, the first cover application station including a sealing tool or a press to attach the first cover layer on the package base;

a loading station for loading a product into the pocket after the first cover layer has been attached to the package base; and a second cover application station disposed downstream of the loading station and configured to attach a second cover layer on the first cover layer after the product has been loaded into the pocket so that the first and second cover layers cooperate to substantially or completely cover the pocket, the second cover application station including a sealing tool or a press to attach the second cover layer on the first cover layer;

wherein the first cover layer comprises first and second strips of material, and the first cover application station is configured to attach the first and second strips of material on the package base so that the first and second strips of material are spaced apart from each other.

23. The packaging machine of claim 22, wherein the first and second strips of material each comprise a plastic film.

24. The packaging machine of claim 22, wherein the first and second strips of material each comprise paper.

* * * * *